United States Patent [19]

Sairanen et al.

[11] Patent Number: 4,553,070

[45] Date of Patent: Nov. 12, 1985

[54] ELECTRONIC BALLAST FOR A DISCHARGE LAMP

[75] Inventors: Martti Sairanen, Espoo; Matti Virta, Helsinki, both of Finland

[73] Assignee: Oy Helvar, Helsinki, Finland

[21] Appl. No.: 395,269

[22] Filed: Jul. 6, 1982

[30] Foreign Application Priority Data

| | | | |
|---|---|---|---|
| Sep. 18, 1981 | [FI] | Finland | 812930 |
| Oct. 21, 1981 | [FI] | Finland | 813298 |
| Jan. 12, 1982 | [FI] | Finland | 820095 |
| Jan. 12, 1982 | [FI] | Finland | 820094 |

[51] Int. Cl.[4] ..... H05B 37/02; H05B 39/04; H05B 41/36

[52] U.S. Cl. ..... 315/209 R; 315/205; 315/207; 315/244; 315/DIG. 7; 363/22; 363/24; 331/113 A

[58] Field of Search ..... 315/DIG. 3, DIG. 5, 315/DIG. 7, 205, 209, 207, 244, 265, 307; 363/22, 24, 139; 331/113 A

[56] References Cited

U.S. PATENT DOCUMENTS

| | | | |
|---|---|---|---|
| 2,892,952 | 6/1959 | McVey | 307/228 |
| 3,896,336 | 7/1975 | Schreiner et al. | 315/226 |
| 4,004,187 | 1/1977 | Walker | 315/205 |
| 4,075,476 | 2/1978 | Pitel | 315/DIG. 5 |
| 4,127,795 | 11/1978 | Knoll | 315/DIG. 7 |
| 4,237,403 | 12/1980 | Davis | 315/205 X |
| 4,277,728 | 7/1981 | Stevens | 315/DIG. 7 |
| 4,370,600 | 1/1983 | Zansky | 315/DIG. 7 |

FOREIGN PATENT DOCUMENTS

| | | | |
|---|---|---|---|
| 2071949 | 9/1981 | United Kingdom | 315/244 |

*Primary Examiner*—Saxfield Chatmon

*Attorney, Agent, or Firm*—Zarley, McKee, Thomte, Voorhees & Sease

[57] ABSTRACT

An electronic ballast for a discharge lamp (8) for restricting and stabilizing the lamps current. The ballast comprises a high frequency oscillator for connection to a D.C. supply which consists of two transistors (1,2) connected in series, with a base drive transformer (3) coupled between them to bring the transistors (1,2) into alternating phase operation. A resonance circuit connected in series with the primary winding (4) of the transformer (3), comprises an inductor (7), resonance capacitors (10 and 11) and a capacitor (9) coupled in parallel with the lamp (8). The lamp (8) is, in turn, connected in series with the resonance circuit. In addition, a filter capacitor (c) having a high charging ability is coupled between the terminals of the D.C. supply. The resonance capacitors (10 and 11) are connected in series between the terminals of the D.C. supply, and diodes (23, 24) are connected parallel to them, and the last part of the resonance circuit is connected to a point common for the capacitors and the diodes, e.g. by means of the electrode (8*a*) of the lamp (8).

6 Claims, 4 Drawing Figures

ELECTRONIC BALLAST FOR A DISCHARGE LAMP

Figure 1:
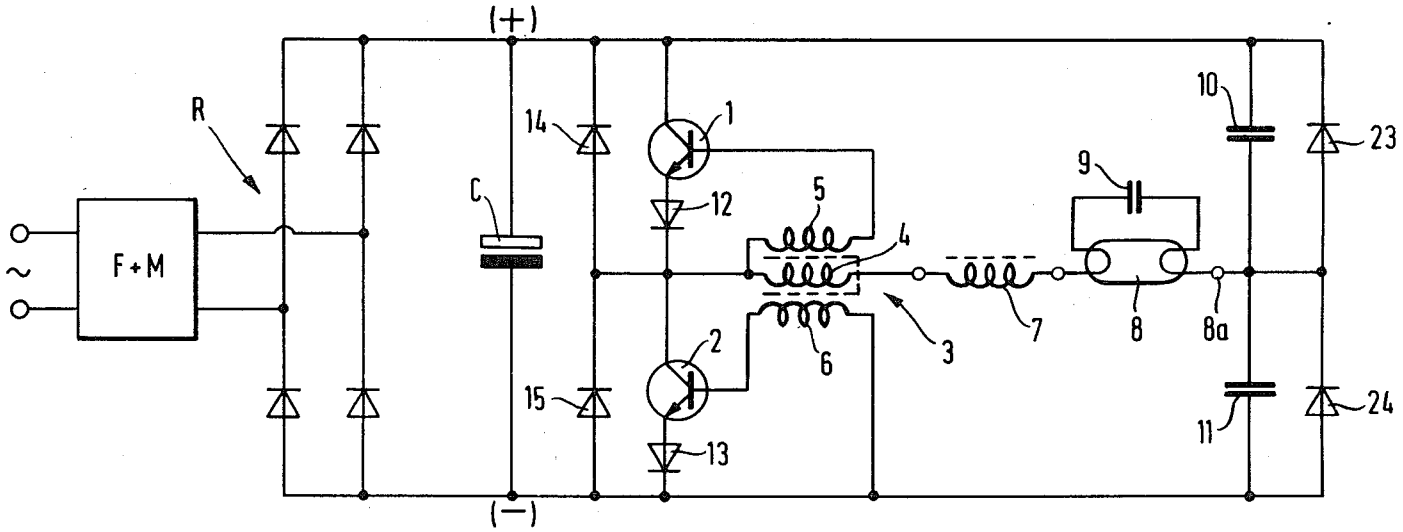

An electronic ballast for a discharge lamp can be accomplished in practice by using a number of different circuit solutions. A characteristic feature of all such solutions is that the device produces electricity of an essentially higher frequency than that of the line voltage, in conjunction with one or more gas discharge lamps. In practice the said frequency generally covers the range 20–120 kHz, and it is produced by electronic switches usually by transistors. High frequency application offers the advantage of lower power consumption in lighting, which is mainly due to improved light efficiency of the lamp in high frequency application as well as to lower power dissipation in the ballast itself.

The invention refers to an electronic ballast for a discharge lamp for the restriction and stabilization of the current, comprising a high frequency oscillator connected to a D.C. supply. The said oscillator is made up of two transistors connected in series, with a base drive transformer coupled inbetween to bring the transistors into alternating phase operation, as well as a resonance circuit connected in series with the primary winding of the transformer, comprising an inductor and resonance capacitors together with a capacitor coupled parallel with lamp, and which lamp in turn is connected in series with the resonance circuit. In addition, a filter capacitor having a high capacitance is coupled between the terminals of the D.C. supply.

The known ballasts of this type are using a resonance capacitor charging at the first half-cycle, while the lamp is obtaining its current when the capacitor is discharging at the second half-cycle. It follows from this procedure that the filter capacitor is charging only at every other half-cycle. This results in a high amplitude for the charging current, a considerable amount of interference caused by harmonic components, and extra power losses in the filter capacitor.

The main aim of the invention is to further develop a ballast of the mentioned type in order to avoid, for instance, the mentioned drawbacks, i.e. partly by radio frequency interference suppression, and partly by reducing power losses in the filter capacitor.

For reaching this aim, the ballast according to the invention is characterized in that the resonance capacitors are connected in series between terminals of the D.C. supply, and diodes are connected parallel to them, and that the final part of the resonance circuit is coupled to a point common for the capacitors and the diodes, e.g. by means of the electrodes of the lamp.

As a consequence of this coupling the frequency of the filter capacitor loading current is doubled, and the amplitude is reduced to one half. Lowering of the amplitude essentially reduces the harmonic components, which lessens radio frequency interference. Because the circuit still needs the same average current, the RMS value of the current charging the filter capacitor is reduced.

One characteristic feature of transistors is that,when the transistor is turned on, rise time of the current is faster than fall time when the transistor is turned off. This phenomenon is called below, storage time.

It is on account of this storage time that in the above-mentioned coupling, where the control voltages of the transistors are of opposite phase and at the same time are changing direction, both transistors are on at the same time. That is, the transistor having its base drive turned off, is still conducting when the other transistor is turned on.

A ballast of the above-mentioned type is known from U.S. Pat. No. 4,075,476, in which the problem arrising from storage time is avoided by a circuit arrangement, where sufficient compensation for transistor storage time is accomplished by making use of separate filter circuits.

An additional aim of the invention is to bring about sufficient limitation of the storage time concerned by the use of a considerably simpler and cheaper circuit solution than the above-mentioned technical level has to offer.

In order to reliaze this aim, the ballast according to a favourable mode of performance of the present invention is characterized in that diodes are connected parallel to switch transistors, in order to decrease the time during which both transistors are conducting at the same time.

Thanks to such circuit arrangement the current rise of the transistors is starting later, not before the forward voltage drop of the diode, and the counter voltage of the base emitter junction, are surpassed.

An additional aim of the invention is to accomplish a filter choke for the ballast of an electronic gas discharge lamp, by means of which it is possible to accomplish sufficient radio frequency interference suppression with essentially smaller costs than previously.

According to the invention this aim is reached by using a filter choke made up of two separate inductor units, connected to both line wires.

An additional problem for the invention to solve is the accomplishment of control of the lamp light level, in connection with a ballast based on a highfrequency resonance circuit of the presented type.

This problem has been solved by utilizing an additional winding in the transistor base drive transformer of the oscillator. A description in more detail follows below in connection with the FIGS. 2 and 3.

Figure 2:
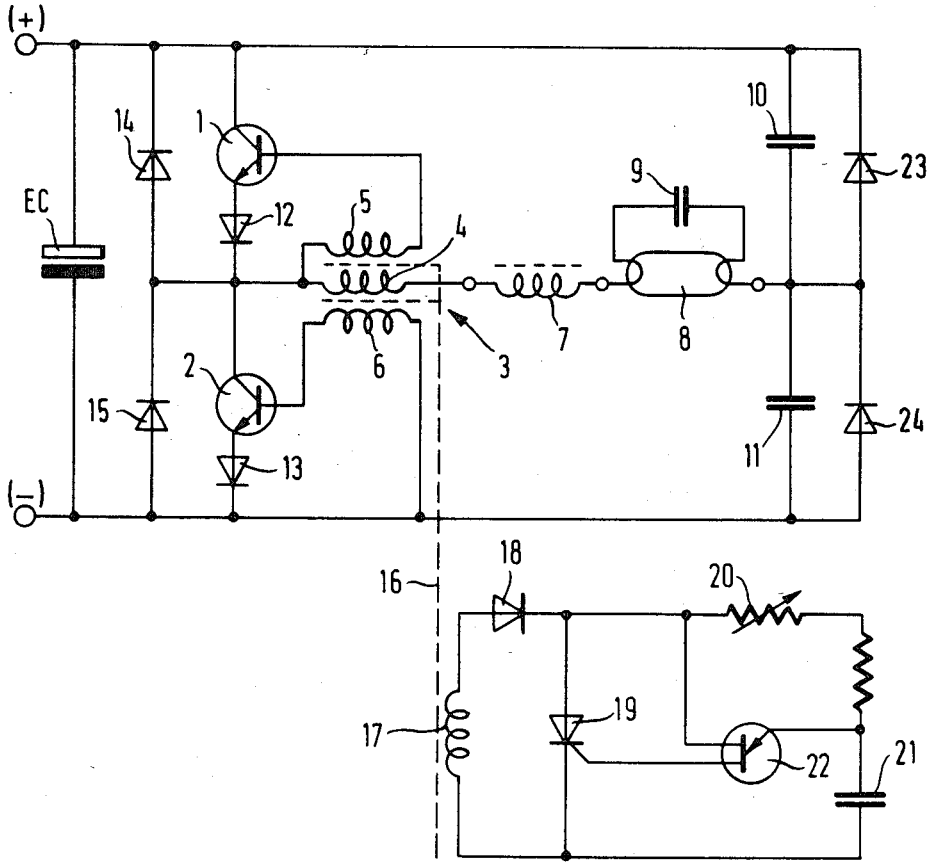

The invention is further described by refering to the enclosed drawings, in which FIG. 1 presents a circuit diagram of the ballast according to the invention, FIG. 2 presents the ballast in FIG. 1 provided with an extra circuit, according to a first embodiment of the invention, for the regulation of the light level.

Figure 3:
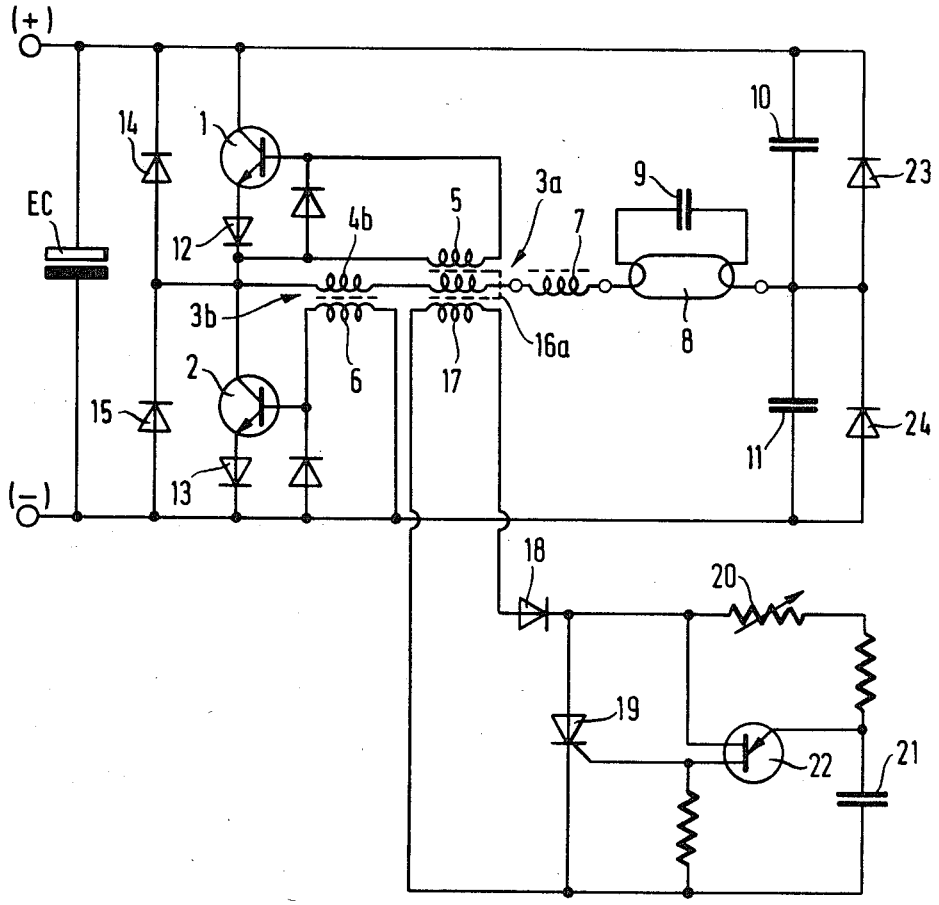

FIG. 3 presents the ballast in FIG. 1 provided with an extra circuit according to a second embodiment of the invention, for the regulation of the light level.

Figure 4:
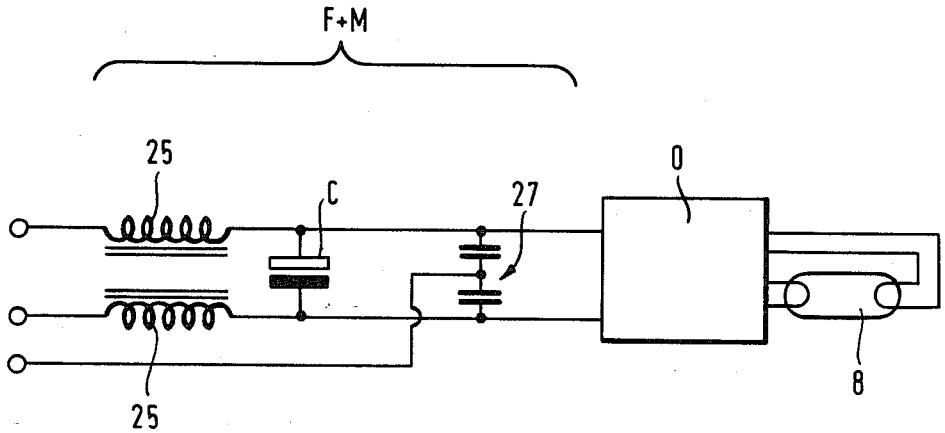

FIG. 4 presents in more detail the connections of the filter choke of the ballast.

In order to simplify presentation, the figures only include the most necessary components in view of operation.

In the embodiment of FIG. 1, the ballast is connected to the A.C. mains by means of the radio frequency filter F, the mains current modifier M, and the rectifier R. Between the D.C. terminals + and −, and the lamp 8, a high frequency oscillator is formed, comprising two series-connected transistors 1 and 2, which are arranged for alternating phase operation in a way to be described further on. Diodes 12 and 13 are connected in series with the emitters of the transistors 1 and 2. One terminal of the primary winding 4 in the base drive transformer 3 of the transistors 1 and 2 is connected between the transistors 1 and 2, and the other terminal is connected by way of the inductor coil (choke) 7 to one electrode of the lamp 8. The other electrode 8*a* of the lamp is connected by means of the resonance capacitors 10 and 11, and the voltage limiter diodes 23 and 24 parallel to them, to opposite poles of the current supply. Between the current supply + and − terminals the electrolytic capacitor C is serving as filter capasitor. Furthermore, the parallel capacitor 9 of the lamp 8 fixes on its part the working frequency during starting before the lamp is on, as well as the lamp voltage. However, during operation the capacitors 10 and 11 are forming the main resonance capacitances in the freely oscillating series resonance circuit, which in addition includes an inductance in the form of a coil 7. If a lamp 8 provided with filament cathodes is used, the current of the capacitor 9 is flowing through the cathodes causing heating of the cathodes. In the case of a so-called cold cathode lamp, however, standing starting without the cathodes warming up, the capacitor 9 can be connected directly between the inductor coil 7 and the point 8*a*.

The secondary windings 5 and 6 of the base drive transformer 3 are connected to the base terminals of the transistors 1 and 2, so as to obtain control voltages of opposite phase. Then, one of the two transistors is conducting when the other is non-conducting, and vice-versa.

One problem in the operation of the above described circuit consists in that the rise time of the current, in turning on the transistor current, is faster than the fall time in switching off the transistor. This storage time, growing still as function of temperature, is the cause of simultaneous conduction of the transistors. In the invention the forward voltage drop of the diodes 12 and 13, coupled in series with the transistors, accomplishes that when the base drive voltage on the secondary side of the transformer 3 is changing direction, at a limited rate determined by the stray capacitance and the inductance of the transformer, the voltage change in the terminals of the secondary windings 5 and 6 increases by the extent of the forward voltage drops of the diodes 12 and 13. This increased voltage change also means a longer time before current starts to flow in the base circuit of the transistors triggered to conduction. As a result of this the total time during which both transistors are conducting, and the total conducted current respectively, essentially decrease. It is to be observed, however, that in practice the larger part of the storage time is controlled by the phase displacement between the base and collector current formed in the transformer. The power loss caused by the storage time can thus be avoided, and in practice completely eliminated by a so far essentially simpler circuit solution. The protective diodes 14 and 15 permit a path for the current of the inductance 7 when both transistors 1 and 2 are in a state of non-conduction.

In the main the circuit operates as follows: the filter capacitor C is charging through the rectifier R to the voltage forming the supply voltage of the circuit. In the freely oscillating resonance circuit the current begins to flow by way of both capacitors 10 and 11 to the electrode 8*a* of the lamp 8, from here by way of the filaments of the lamp 8 and the capacitor 9, as well as through the inductance and the primary winding of the transformer 3, and the conducting transistor 2 when the circuit is closing. It is observed that in the oscillatory circuit the capacitors 10 and 11 are connected parallel, and the capacitor 9 in series with this parallel coupling. In order for the capacitor 9 to fix a starting frequency for the lamp 8 higher than the working frequency, the capacitance of the capacitor 9 is about $\frac{1}{2}$–$\frac{1}{4}$, preferably about $\frac{1}{3}$ of the capacitance formed by the parallel coupling of the capacitors 10 and 11, i.e. the sum of these capacitances. As the current in the above-mentioned resonance circuit is beginning to decrease, essentially at a sufficiently rising counter voltage of the capacitor 9, the control voltages induced in the secondary windings 5 and 6 of the transformer 3 will bring the transistor 2 into non-conducting state, at the same time as the transistor 1 will be conducting. The current now strarts flowing in the opposite direction, i.e. by way of the winding 4 and the coil 7, the capacitor 9, and the parallel connection of the capacitors 10 and 11, until the counter voltage formed in the capacitor 9 again is restricting the flow of current for a change of direction. In this way the curve of the current flowing in the circuit becomes sinusoidal in shape, and thus the current flowing through the transistors at the moment of switching on approaches zero. Under the said circumstances the switching losses are brought to a minimum. The current flowing through the capacitor 9 is heating the cathode filaments of the lamp 8.

The cold kathode discharge lamps itself of course is situated directly parallel with the capacitor 9. When the lamp 8 is turned on, a resistance-like impedance formed the lamp 8 is connecting parallel with the capacitor 9. The working frequency is now essentially decreasing in relation to the starting frequency, because the resonance frequency is now mainly fixing the parallel coupling of the capacitors 10 and 11. However, current suited for heating the filaments of the lamp 8 still is passing through the capacitor 9.

Due to the negative nature of the resistance formed by the lamp 8, the voltage of the terminal 8*a* would not keep stable unless the diodes 23 and 24 were arranged parallel with the capacitors 10 and 11. Even one diode 23 or 24 is sufficient for this purpose of stabilization. If, for instance, the voltage of the terminal 8*a* tends to increase as a result of decreasing resistance of the lamp 8, or of increasing lamp current, excessive power is leaving the resonance circuit via the diode 23 and/or 24 for return to the capacitor C. The power charging in the capacitors 10 and 11 at each half-cycle will be accurately rationed and thus the voltage in the terminal 8a stabilized.

A noteworthy additional advantage of the invention is that the mutual realtion between the capacitors 9 and respectively, 10 and 11 restricts the starting voltage, which extends the life of the lamp. Preferably the capacitors 10 and 11 are of equal size, so that the loading or the so-called ripple current of the capacitor at both half-cycles is equal, which is optimum in view of radio frequency interference, and also in view of the loading of the capacitor C, because expressly the RMS-value of the A.C. component is heating the capacitor C. If the light level of the lamp 8 is regulated so as to reduce it, by increasing the switching frequency of the transistor switches 1 and 2, the filament current flowing through the capacitor 9 increases, and the lamp 8 does not turn off even at low values of light level regulation. The stabilizing diodes 23 and 24 are of particular significance just in the regulation of the light level of the lamp 8, when the resistance of the lamp 8 is varying strongly.

FIG. 2 presents an extra secondary winding 17, according to the invention on the core 16 of the base drive transformer 3 for the control of the lighting level of the lamp 8, and a series circuit of a tyristor 19 and a diode 18 connected parallel with the said secondary winding 17. A control circuit 20–22 is connected to the control electrode of the tyristor 19 for switching on the tyristor 19 and short-circuiting the winding 17 at every other half-cycle of desired phase. The operation of the control circuit takes place as follows: by way of the diode 18 and the control potentiometer 20 the capacitor 21 is charging during every other half-cycle at a rate, the time constant of which is dependent on the regulation value of the potentiometer 20. When the capacitor 21 is sufficiently charged, the unijunction transistor 22 turns on to a conducting state, so as to obtain a drive voltage for triggering the tyristor 19 to the state of conduction. As the secondary winding 17 is short-circuited, the base drive voltage of windings 5 and 6 correspondingly decreases, at which the drive voltage of the transistor 1 or 2 conducting at the respective half-cycle, momentarily reverses. This is due to the collector current better being able to flow through the base than through the emitter, on account of the mentioned low base voltage. Then the respective transistor is rapidly turned off to a non-conducting state. This shortening of the duration of the base current of one of the transistors is building up some working frequency in the resonance circuit. The growing frequency means that the inductance 7 makes more resistance to the current flow. At increasing frequency the current of the capacitor 9 also increases. On account of the above reasons the current of the fluorescent lamp 8 is reduced, and the light likewise, at the same time as the filament power of the lamp electrodes increases, which prevents the lamp from turning off at small regulation values for the light level.

In this working example current turn-off is also taking place at the other half-cycle on the basis of the base drive transformer core 16 becoming saturaged, which is due to that the point of operation on the hysteresis curve of the core is moving to the other saturation edge of the curve under the influence of the current of the winding 17.

The disadvantage of the regulation principle described above is that the efficiency is lowered when the light level is reduced. It has been observed, however, that by the regulation principle according to FIG. 3, and to be described below, a better efficiency is obtained as compared to the working example in FIG. 2, in lowering the light level.

The working example in FIG. 3 differs from the working example in FIG. 2 only in so far as the base drive transformer 3 is concerned. Otherwise, the same reference numbers are used as in FIG. 2, while reference is made to the description of the mode of application in FIG. 2.

Both transistors 1 and 2 have their own separate base drive transformer 3*a* and 3*b*, the primary windings 4*a* and 4*b* of which ar series connected with part of the mentioned series resonance circuit. The transformer 3*a* secondary winding 5 controls transistor 1, and the transformer 3*b* secondary winding 6 controls transistor 2. The extra secondary winding 17, to be circuited by the circuit 19–22, is arranged only on the core 16*a* of the transformer 3*a*. The transistor 2, which is not regulated, obtains a sufficient base current, on account of the current value at the moment of switching off being small, due to the resonance circuit. The controlled base current of the transistor is strongly negative at the moment of switching off, which to a marked extent reduces the switching losses. The transistor losses then are also lowering in comparison with using one base drive transformer. In the mode of application in FIG. 3, also the working frequency is growing less, with the result that the switching losses are reduced.

The advantage of both working examples illustrated above is that the regulating circuit is galvanically insulated from the electronic ballast.

By means of the radio interference filtering circuit F the radio frequency interferences caused by the electronic ballast are filtered, so that they do not spread to the line wires. The mains current modifier M (low frequency filter) is an electronically or by filtering components accomplished unit making the line current sufficiently sinusoidal. Interntional provisions (IEC publ. 82 and VDE 0712) include certain requirements for the shape of the line current curve of a ballast, defined by means of superharmonic components present in the curve form of the current. The direct rectifier bridge R leading the current to the filter capacitor, does not satisfy this requirement.

It is known to accomplish the mentioned requirement for the curve form of current electronically, by a separate converter circuit, or by driving the opertion of the high frequency oscillator, so that the line current at each moment suffiently corresponds to line voltage as far as phase and shape is concerned. The drawback of the former solution is the comparatively complicated and expensive constructions, and the disadvantage of the latter in the flickering is formed in the lamp current, which is true in conventional ballast. Then the increase in efficiency obatainable by the electronic ballast is not as high as when the lamps are functioning by D.C. light without flickering.

It is also known to use in modifying the line current, a passive circuit, realized by an inductor and a capacitor. By the mentioned components suppression of radio-frequency intefrerence is also accomplished, at the same time. Previously known is the use of an inductor construction having two windings on the same core, a so-called symmetric choke. In using an inductor of this type, a certain suppression of radio frequency interference is realized, but not quite sufficient to do without a separate radio interference inductor included in the circuit, in order to fulfill the international requirements laid down for radio interferences. The addition of a separate radio interference inductor into the electronic ballast means a cost which is nearly the same or higher than the price of the corresponding conventional discharge lamp inductor used by the luminaire industry.

The filtering inductor according to the invention is illustrated in FIG. 4, in which the high-frequency oscillator according to FIG. 1 is marked by block O.

According to the invention the symmetric filtering inductors made on one single core is replaced by two smaller, separate inductors 25, connected to different line wires The inductors 25 and the filter capacitor C together are forming the filtering circuit, by means of which the curve shape of the line current is modified in accordance with requirements. A radio frequency interference suppression is then also obtained, which is of such magnitude that no separate radio frequency interference inductor at all is needed.

In this way it is possible to use a filter inductor 25 constructed as the inductor of a normal discharge lamp, which is manufactured automatically and priced below the price of a separate radio frequency interference inductor. Also, the manufacturing cost of two separate inductors 25 is clearly below that of one corresponding, symmetric double-winding inductor. In total costs of manufacture, a saving with respect to filtering and radio frequency interference inductors is obtained corresponding to 50–60 percent. The interference suppression capacitors belonging to the radio interference filtering circuit has been marked by reference numeral 27.

We claim:

1. An electronic ballast for discharge lamp (8) for restriction and stbilization of the current, comprising:

a high frequency oscillator electrically connected between the terminals of a direct current supply and including a pair of series connected transistors (1, 2) with a first base drive transformer (3) coupled therebetween so as to bring said transistors (1, 2) into alternating phase operation, a resonance circuit including an inductor (7) connected in a series between the primary winding (4) of the transformer (3) and said lamp (8), resonance capacitors (10, 11) connected in series with said lamp (8) and in series between the terminals of sid direct current supply, and an igniting capacitor (a) coupled parallel to said lamp (8), said igniting capacitor (9) being coupled parallel to the lamp (8) between the opposite ends of the electrode filaments thereof, and having a capacitance about $\frac{1}{2}$–$\frac{1}{4}$ of the sum of the capacitances of said resonance capacitors (10 and 11), a filter capacitor (c) having a high charging ability and being coupled between the terminals of said direct current supply, a first set of diodes (23, 24) connected parallel to said resonance capacitors (10, 11), said sries connection of said inductor (7) and said lamp (8) being connected to a point common for said resonance capacitors (10, 11) and said diodes (23, 24).

2. Electronic ballast according to patent claim 1, characterized in that one of said diodes of said first set of diodes (23 and 24) is connected parallel only to one of the resonance capacitors (10 and 11).

3. Electronic ballast according to patent claim 1, characterized in that a second set of diodes (12, 13) are connected in series with the switching transistors (1, 2), whereby the time during which both transistors are on simultaneously is reduced.

4. Electronic ballast according to claim 1, characterized in that an electronic switch (19) is coupled between the terminals of the secondary winding (17) of the base drive transformer (3), and a control circuit (20, 22) is connected to the control electrode of said switch (19) to bring it to the state of conduction at every other half-period in desired phase.

5. Electronic ballast according to claim 1 further comprising a second base drive transformer, one of said first and second transformers (*3a, 3b*) being connected to each of said transistors (1, 2), an electronic switch (19) connected between the terminals of the secondary winding (17) of one of said first and second transformers and a control circuit (20, 22) connected to the control electrode of said switch (19) to bring said switch to the state of conduction at every other half-period of desired phase.

6. Electronic ballast according to patent claims 4 or 5, characterized in that the said electronic switch is a tyrister (19), and the said control circuit is a potentiometer (20), connected to the grid of the tyristor by way of the unijunction transistor (22).

* * * * *